United States Patent [19]

Burgat et al.

[11] 4,156,334

[45] * May 29, 1979

[54] APPARATUS FOR THE OPENING OF BAGS

[75] Inventors: Georges Burgat, Saint-Didier-au-Mont-d'Or; Bernard Guillemaut, Lyons, both of France

[73] Assignee: Societe Anonyme dite Thimmonier S.A., Lyons, France

[ * ] Notice: The portion of the term of this patent subsequent to Jul. 5, 1994, has been disclaimed.

[21] Appl. No.: 830,333

[22] Filed: Sep. 2, 1977

[30] Foreign Application Priority Data

Sep. 3, 1976 [FR] France ..... 76 27066

[51] Int. Cl.[2] ..... B65B 43/30

[52] U.S. Cl. ..... 53/385; 53/386; 53/571

[58] Field of Search ..... 53/188, 190, 384, 385, 53/386

[56] References Cited

U.S. PATENT DOCUMENTS

| | | | |
|---|---|---|---|
| 1,886,376 | 11/1932 | Dambacher | 53/188 X |
| 4,033,096 | 7/1977 | Burgat et al. | 53/188 X |

*Primary Examiner*—Travis S. McGehee

*Attorney, Agent, or Firm*—Karl F. Ross

[57] ABSTRACT

An apparatus for the opening of flat bags, particularly of synthetic resin, originally in a stack, comprises a first movable device turned toward the stack which is oriented horizontally with the bags lying vertically and carrying suction heads adapted to draw a bag of the stack away from a magazine containing same. A second movable member has suction heads turned toward the first movable member and is adapted to grip the rear face of a bag withdrawn by the first from the magazine so that separation of the two members effects an opening of the bag. A third device is shiftable vertically to urge the open bags between the pincers of a transfer chain which carries the open bag to a filling station.

6 Claims, 11 Drawing Figures

APPARATUS FOR THE OPENING OF BAGS

FIELD OF THE INVENTION

The present invention relates to an apparatus for the de-stacking and opening of bags and, more particularly, to an apparatus for the opening of bags adapted to form part of a machine for the automatic filling thereof.

BACKGROUND OF THE INVENTION

Synthetic-resin bags which are open at one end are available in stacks and are adapted to be filled with condiments, comestibles or other materials in automatic filling machines. For such machines to be effective, it is necessary to de-stack the bag, i.e., remove the individual bag from a stack thereof in a magazine, and to open the bag to permit the filling thereof.

The filling machine may be provided with a transfer chain onto which the open bags are fed for transport to the filling device.

The bags of interest for the purposes of the present invention are those which are composed of a relatively flexible synthetic resin thermoplastic which is thermally sealable and which comprises two substantially rectangular walls connected by rectilinear thermal seams or welds on three sides while the fourth side remains unseamed or unsealed, to permit its opening for filling.

Such bags are commercially available under the name "DOYPACK" and have two lateral walls which are substantially rectangular and are provided at the bottom with gussets or weld seams generally having a bottom of W-section pattern so that the lateral walls can be spread apart to permit the bag to be self-standing (see U.S. Pat. Nos. 3,380,646, 3,637,133 and 3,935,993).

The known processes for opening such bags include the following:

In a first system which has been used commercially, the bags are withdrawn from a magazine or supply in which they are stored flat by a member provided with suction heads. The suction heads are evacuated to attract the flat bag from the magazine. The bags on this member are then introduced between pincers of a support mounted on the transfer chain. At a downstream location or station, the mouth of the bag is opened by means of inclined planes provided with suction devices between which the mouth of the bag is passed. Full opening of the bag is effected by blowing through the open mouth with compressed air at low pressure.

In certain other machines, the opening system consists of means for opening the upper lips of the bag by suction and then introducing into the bag a mechanical element which effects the unfolding of the bottom of the bag and hence complete opening thereof.

The two systems have been found to have practical drawbacks of considerable significance:

In the case of the first system, it is found that if the bag is difficult to open, a significant overpressure develops within the bag. The spreading of the bottom is thus effected suddenly which produces a shock wave capable of destroying or damaging the bag. Furthermore, with certain types of bags, opening does not occur by inflation and in such machines, there is a significant percentage of non-opened bags.

In the second case, the introduction of a mechanical member into the fragile bag also is capable of damaging the film from which it is made. Furthermore, the introduction of a mechanical element to some depth within the bag which is to be subjected to a horizontal displacement (translation) reduces sharply the cadence at which the machine can operate and creates the supplemental risk that the two mutually perpendicular movements will interfere with one another.

Finally, in both cases it is necessary to provide, on the transfer chain, a special space for carrying out this opening of the bags or sacks which, depending upon the size of this space, results in an increase in the size of the machine and the space occupied thereby.

It should be noted further that there are known devices which comprise movable members carrying suction heads which are capable of drawing the bags or sacks from the magazine and then opening them. These devices, however, have been highly complex heretofore and generally require three members movable in translation as well as two members which describe a rotating movement. In other words, such systems have the same inconveniences as the other systems described previously with respect to the possible interference of different types of movements, complexity and synchronization because they also effect a withdrawal of the bag from the magazine at a first location and an opening of the bag at a second location spaced from and distinct from the first. The requirement that two separate stations be provided is, of course, a significant disadvantage.

OBJECTS OF THE INVENTION

It is the principal object of the present invention to provide a device for the destacking and opening of bags whereby the aforedescribed drawbacks and disadvantages are avoided.

It is another object of the invention to provide a relatively simple apparatus for the destacking and opening of bags which permits a single station to be used for both operations and hence allows the machine to be relatively small.

Still another object of the invention is to provide an apparatus for the purposes described which is of simple construction and which has relatively simple and easily synchronized movements and hence is highly compatible with machines for filling the bags especially when the latter are advanced in a plurality of lines parallel to one another upon a transfer chain.

SUMMARY OF THE INVENTION

These objects and others which will become apparent hereinafter are attained, in accordance with the present invention, in an apparatus for the de-stacking and opening of bags, especially rectangular bags of the type described, which apparatus comprises, in combination:

(a) A first movable member provided with a suction head turned toward the bag at the end of a stack and displaceable horizontally in the direction thereof, parallel to the axis of the horizontal magazine containing the stack. The stack thus extends horizontally with the bags being disposed vertically and the bag to be engaged by the suction head of the first member is disposed at the end of the stack.

(b) A second movable member provided with a respective suction head, turned in a direction opposite the first suction head, i.e., toward the first movable member, and displaceable horizontally in a direction perpendicular to the axis of the magazine and the stack between a first position in which it is juxtaposed with the first member and disposed between the magazine and the bag withdrawn by the first member therefrom, and a second position in which the second member is disposed laterally outside of the path of the bag withdrawn from the stack, i.e., laterally offset from the magazine and the stack.

(c) Means independent of said members and adapted to lower the bag which is opened by the two members upon relative displacement thereof parallel to the axis of the stack so as to feed the open bag between a pair of pincers disposed on a transfer chain below the stack and the two members, the pincers engaging the vertical side seams of the open bag.

According to a first embodiment of the invention, the means adapted to lower the stack is constituted by a pusher which is vertically displaceable independently of the first and second members and is turned downwardly so that its axis of displacement intersects the axis of the magazine. The pusher is adapted to be disposed above the pincers of the transfer chain when the latter is temporarily halted with the pincers in alignment with the pusher, thereby enabling the vertical displacement of the pusher to carry an open bag downwardly.

The two movable members provided with suction heads as described previously and the pusher thus permit all of the essential functions for destacking and opening to be carried out above the transfer chain so that a completely open bag is disposed upon the transfer chain.

The following operational sequence is thus performed:

(a) While the second movable member is initially spaced laterally from the axis of the magazine, the first movable member is displaced toward a bag at the end of the magazine or stack during a forward stroke of its forward-return movement.

(b) The suction heads of the first member having engaged the first bag of the stack, the first member is displaced on its return movement, thereby spacing the rear face of the bag from the stack and permitting the first horizontal stroke of the second member to bring the latter between the first bag and the stack, i.e., into alignment with the first member along the axis of the stack.

(c) The first member is then again advanced toward the stack until the rear surface of the bag engaged thereby has come into the effective region of the head of the second member, at which time the second member engages the rear face of the bag by suction.

(d) The first member is then advanced in the direction of its initial retraction movement to spread open the lateral walls of the bag, thereby opening the mouth thereof.

(e) The pusher is then advanced downwardly to press the open bag between the pincers of the transfer chain.

(f) The second member is retracted to a position in which it is again laterally offset from the magazine and the process can be repeated.

Both members thus engage in simple forward-and-back rectilinear movements while the pusher engages in a vertical rectilinear forward-and-back movement. As a result the movements are relatively simple and readily synchronized by pneumatic, electrical or other conventional means.

During the downward displacement of the bag by the pusher, the suction heads can be de-energized or inactivated, thereby permitting the downward movement to be effected without stress upon the bag and without vertical movement of either member.

With such an apparatus it has become possible, as is especially advantageous for automatic filling machines, to maintain the path of the pincers which transport the open bags parallel to the axis of the magazine.

In a second embodiment of the invention, the means for effecting the downward displacement of the destacked and open bags can include a jet of air directed downwardly. This pneumatic solution has been found to be advantageous in certain cases in which the pusher is too slow. However, we prefer to combine both solutions, i.e., to provide the pusher with a pneumatic jet directed downwardly so that both the effect of the air jet and the mechanical effect of the pusher are combined to effect descent of the bag.

It has been found to be advantageous to provide a support table beneath the transport chain to form a stop for the bag when the latter is lowered.

The jet of air is continuously directed into the bag during the entire lowering operation and until closure of the pincers of the transfer chain on the bag.

According to a further feature of the invention, a pair of movable guide members, swingable about vertical axes, are disposed between the level of the axis of the magazine and the level of the transfer-chain pincers to form vertical guides for the edges of the bag during the descent thereof, i.e., during the downward displacement of the bag by the pusher. These movable guide members are closed on the longitudinal welds of the bag after the opening of the latter and play the role of translation guides which are aligned with the pincers of the transfer chain, the guides being effective until the pincers of the transfer chain grip these longitudinal edges (see our U.S. Pat. No. 4,033,096).

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 11:
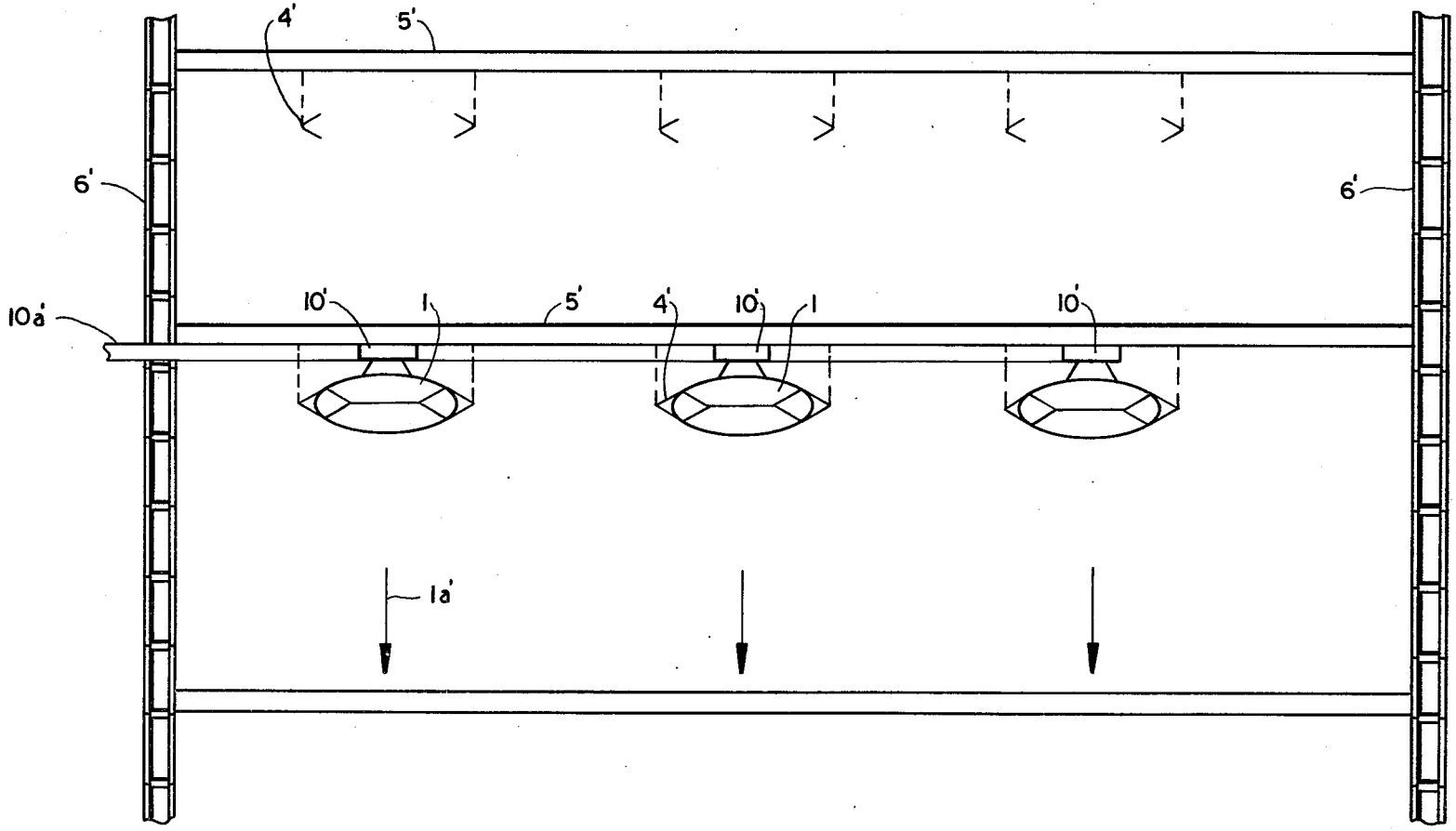
FIG. 11 is a diagrammatic plan view showing a chain for advancing the bags in a plurality of parallel lines.

The apparatus shown in the drawing is intended to remove one-by-one the flat bags or sacks 1 which are disposed vertically in a magazine or storage rack 2 having a horizontal axis as indicated at 3 and to open each bag and place the same in pincers 4 carried by traverse bars 5 connected to an endless chain 6. These chains and traverses constitute an endless conveyor which displaces the bags parallel to the axis 3 of the magazine as indicated by an arrow 7. Each traverse 5, as shown in FIG. 11, carries a plurality of pairs of pincers 4 as represented at 4' on the traverse 5', so that a plurality of such bags are able to be advanced in a plurality of parallel lines.

The principal elements of the device according to the invention, represented for one of the rows of bags of the transfer chain are the following:

a first movable member 8 carrying the suction heads 9 turned toward the first bag 1 of the magazine and displaceable horizontally parallel to the axis 3 of the magazine in a reciprocating or back-and-forth motion;

a second movable member 10 carrying the suction heads 11 turned in a direction opposite the direction of orientation of the first suction heads, is displaceable horizontally in a direction perpendicular to the axis 3 of the magazine and is reciprocatable in a horizontal direction so as to be positionable between the magazine 2 and the first movable member 8; and two movable pincers 12 forming guides as previously described and disposed below the axis 3. These pincers are mounted to pivot about vertical axes 13. The axes 13 are carried by a fixed support 14 disposed to opposite sides of the axis of the magazine 2 and serving as a guide for the rod 15 carrying the first movable member 8.

A pusher 16 is carried by another rod 17 and is turned downwardly while being displaceable by this rod vertically along an axis 18 which intersects the axis 3 of the magazine. As will be described in greater detail hereinafter, the pusher 16 may be provided at its downwardly turned face, not shown, with a nozzle for directing a jet of compressed air at low pressure downwardly thereby supplementing the downward movement of the pusher with a downward air force.

The pincers 4 of the transfer chain are disposed, during intermittent stops of the transfer chain, directly beneath respective guides 12. They are also pivotally mounted on the traverses 5 or 5' for pivotal movement about vertical axes 19 thereby enabling the pincers to grip the longitudinal edges of the open bag.

Figure 7:
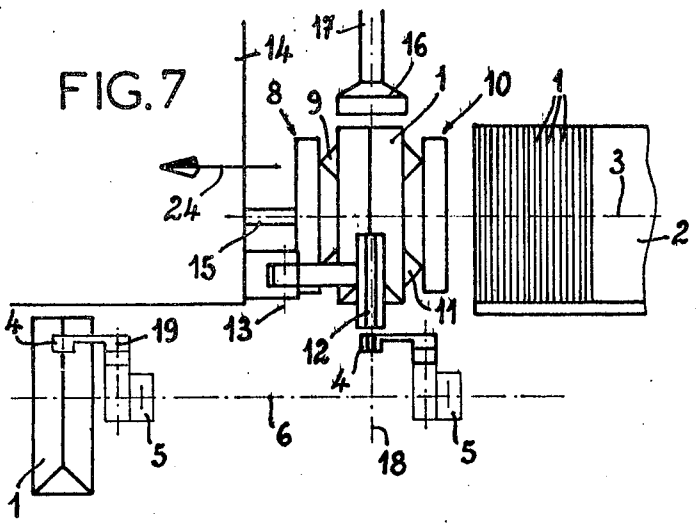
FIGS. 7 and 8 are views analogous to those of FIGS. 3 and 4 but illustrating a fourth phase of the operational cycle.

It is to be noted, for a better understanding of the drawing, that certain of the aforedescribed elements have not been shown in all figures. Thus FIG. 7 represents the complete device while elements have been omitted from the other figures for clarity.

The means for actuating the two members 8 and 10, the movable guides 12 and the chains 6 with their pincers 4 and the means for creating the suction necessary for operation of the heads 9 and 11 have not been illustrated and constitute mechanisms or systems well known in the art (U.S. Pat. No. 4,033,096). They can, for example, be pneumatic actuated systems operated by cams, limit switches or the like.

Figure 1:
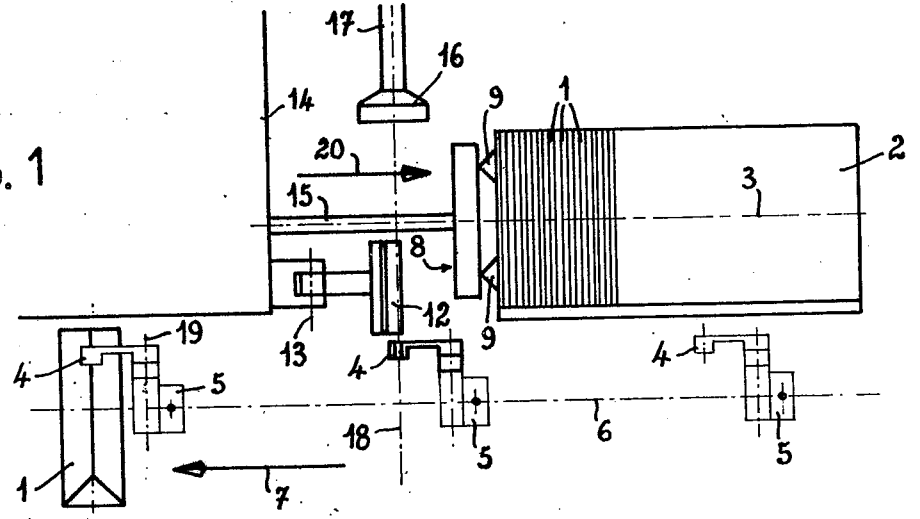
FIG. 1 is a side-elevational view, partly in diagrammatic form and with certain portions of the device omitted, illustrating an apparatus according to the invention in a first phase of its operational cycle.
Figure 2:
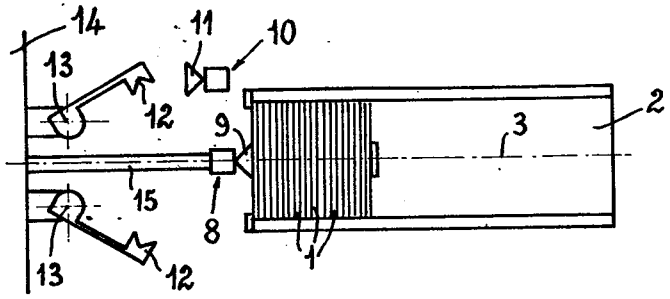
FIG. 2 is a plan view from above of the device in the position shown in FIG. 1.

The functioning of the apparatus is cyclical and comprises the following phases:

At the start of a cycle, the two members 8 and 10 occupy their rest positions illustrated in FIGS. 1 and 2. Thus the member 10 is disposed to one side of the path of the bags from the magazine 2 and hence to one side of the axis 3 while the member 8 is retracted to the left. The member 8 is then advanced in the direction of the magazine 2 as represented by the arrow 20 until its suction heads 9 come in contact with the first bag 1. During this first phase, the guides 12 are in their open positions, i.e., are swung outwardly as shown more particularly in FIG. 2.

Figure 3:
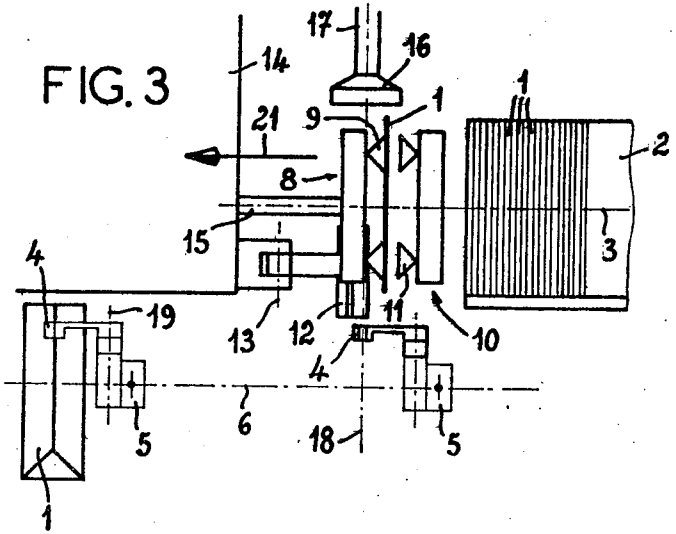
FIG. 3 is a partial side view illustrating essentially the same elements as those in FIG. 1 but additionally showing a second movable member in a second phase of its operating cycle.
Figure 4:
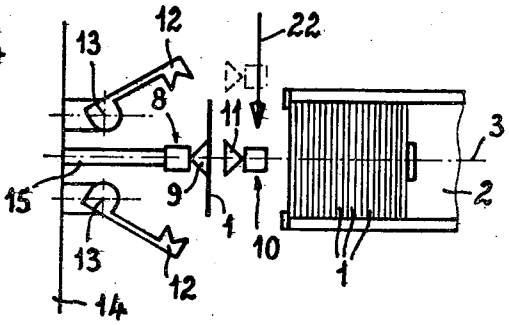
FIG. 4 is a plan view from above of the device in the position shown in FIG. 3.

During the next phase, corresponding to FIGS. 3 and 4, the movable member 2 retracts in the direction of arrow 21, the suction heads having been evacuated, to draw the fist bag 1 away from the magazine 2 which can be provided with retainers holding the remaining bags in place. The other movable member 10 is displaced, as soon as a clearance is provided between the bag 1 and the remaining bags in the magazine 2, as represented by the arrow 22 horizontally until it is disposed between the magazine and the first member 8, i.e., in line with the first member 8 along the axis 3. The suction heads 9 and 11 are thus disposed face-to-face, i.e., are juxtaposed.

Figure 5:
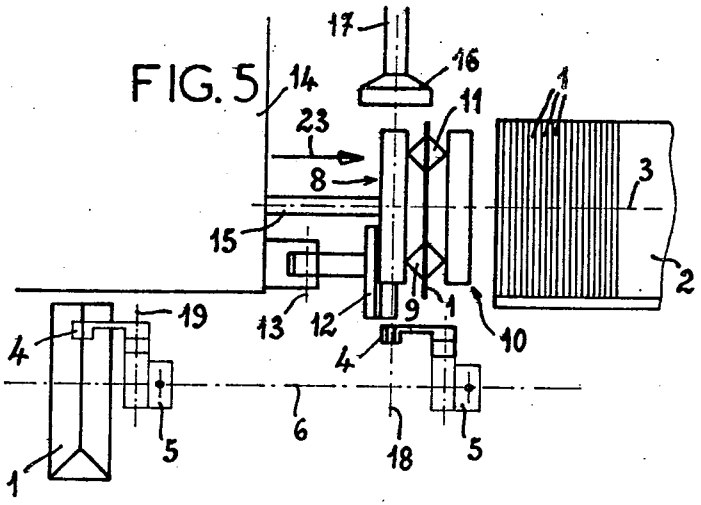
FIGS. 5 and 6 are views analogous to those of FIGS. 3 and 4 illustrating a third phase of the operational cycle.
Figure 6:
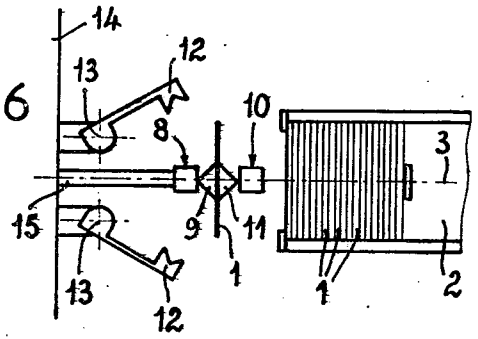

During the third phase, illustrated more particularly in FIGS. 5 and 6, the member 8, whose suction heads 9 retain the bag 1 as previously noted, is advanced to the right in the direction of the magazine (arrow 23) to carry the bag against the suction heads 11 of the other member 10 which remains fixed in the position shown. The suction heads 11 of member 10 are then evacuated.

As a result, the opposite lateral faces or sides of the bag are engaged by suction heads of the two members 8 and 10.

Figure 8:
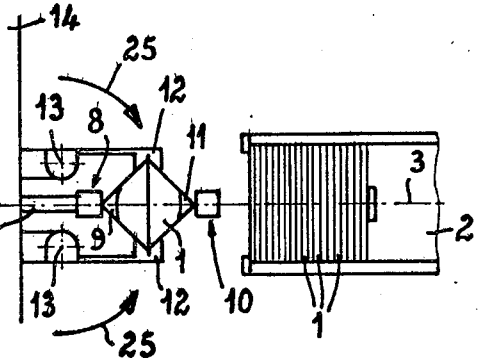

In the next phase, represented in FIGS. 7 and 8, the member 8 is again retracted in the direction of arrow 24 while the member 10 remains in place. The opposite lateral walls are thereby drawn apart by the suction heads 9 and 11 and the bag is opened so that is upper end can receive a material to be packed. The bottom, having the cross-section of a W, as is common in the type of bag marketed under the name "DOYPACK," can thereby be fully opened and the bottom spread.

At the same time that the bag 1 is opened in the manner described in connection with FIGS. 7 and 8, the two guides 12 are swung inwardly to engage the longitudinal weld seams along the opposite vertical edges of the bag. The pivoting movement of the guides 12 is represented by the arrows 25. At this point, the suction heads 9 and 11 can be deactivated since the bag is held open between the guides 12. The member 8 is then retracted further in the direction of arrow 24.

Figure 9:
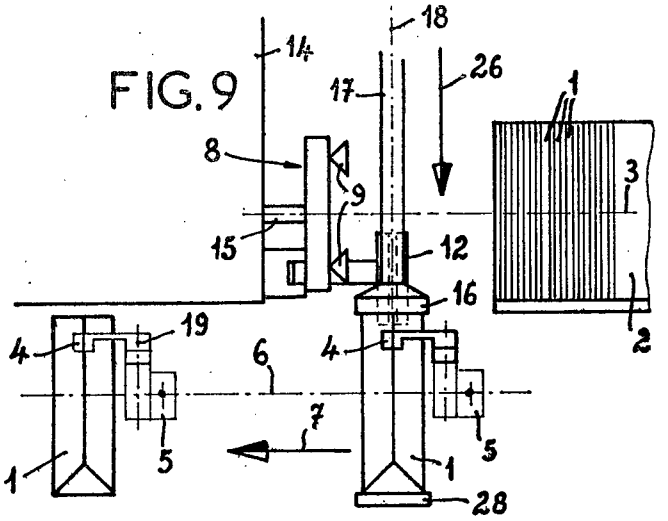
FIGS. 9 and 10 are other analogous views showing the fifth and last phases of the operational cycle.
Figure 10:
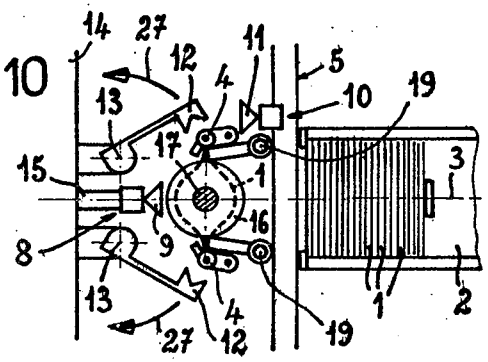

In the fifth and last phase of the cycle, corresponding to FIGS. 9 and 10, the movable member 11, whose suction heads 11 have been vented, is displaced laterally into its original position (FIG. 10) and the pusher 16 is displaced downwardly (arrow 26) along the axis 18 to entrain the open bag 1 in the downward direction.

The bag slides within the guides 12 which are maintained in their inwardly swung position, until the longitudinal edges of the bag pass between the lower pincers 4 which, during this operation, are open and are disposed directly beneath the two guides 12.

When the bag 1 contacts the support table 28 beneath the path of the chain, the two guides 12 can be swung outwardly (arrows 27).

It should be noted that the pusher 16 also serves to continue the opening operation of the bag and, if provided with a nozzle emitting a jet of air, ensures slight inflation of the bag during the descent of the latter. The table 28 serves as an abutment ensuring a precise positioning of the bag at the end of its descent.

Finally, the pusher 16 is raised into its upper position (FIG. 1) and the chains 6 are displaced as represented by the arrow 7 until the next pair of pincers is disposed beneath the opening and destacking device. A new cycle, identical to that which has already been described, is then commenced.

It will be apparent that, when the device is of the type shown in FIG. 11, in which the bags are advanced in a plurality of parallel lines 4a' on a chain 6' parallel to the axes of respective magazines, all of the functioning elements which are to operate synchronously can be provided on common movable supports. This has been shown for the movable members 10' which are carried by a common support 10a' for movement perpendicular to the axes of the magazines.

The apparatus described has numerous advantages over the prior art systems.

Firstly, the apparatus is extremely compact since it provides a single station for the destacking of the destacking and opening of the bags, these two operations occurring in the same space.

Secondly, tests have shown that the apparatus is capable of opening all of the bags which can be fed by the magazine, including those which are relatively rigid or stiff and those which are composed of thin films and hence are highly pliable. With stiffer bags it is merely necessary to provide more suction heads on the movable members and/or to properly dispose the suction heads to ensure full spreading of the opposite walls of the bag.

Finally, the device of the present invention has been found to open the bags without any danger of deforming the bottoms thereof or of inadvertent rupture because an over pressure cannot be generated within the bag accidently. Furthermore, no mechanical tool is inserted to engage the bottom.

Naturally, the invention is not limited to the single embodiment illustrated and described above but includes all variants within the spirit and scope of the appended claims.

We claim:

1. An apparatus for the destacking and opening of bags which comprises:

a horizontally disposed magazine provided with a horizontal stack of said bags fed to an end of said magazine, said magazine having a horizontal axis;

a first movable member provided with suction heads turned toward the first bag of said stack and displaceable horizontally toward and away from said magazine parallel to the axis thereof;

a second movable member having suction heads turned in a direction opposite the suction heads of said first member and displaceable horizontally in a direction perpendicular to the axis of said magazine between a first position in which said second member is disposed between said magazine and said first member in juxtaposition with said first member and a second position wherein said second member is disposed out of the path of a bag withdrawn from said magazine;

pusher means operable independently of said members, adapted to displace an open bag between said members downwardly; and a transfer chain disposed below said magazine and displaceable parallel thereto, said chain being formed with a plurality of pairs of pincers each adapted to receive a downwardly displaced opened bag beneath said pusher means upon successive positioning of said pairs of pincers therebelow.

2. The apparatus defined in claim 1 wherein said pusher means comprises a pusher turned downwardly and displaceable vertically along an axis intersecting the axis of said magazine and above the pincers on said transfer chain.

3. The apparatus defined in claim 2 wherein said pusher is constructed and arranged to partially inflate said bags at least at the ends of the respective descents.

4. The apparatus defined in claim 1 wherein said pusher means includes means directing a jet of air downwardly to displace each bag downwardly into engagement with a respective pair of pincers.

5. The apparatus defined in claim 1 further comprising a pair of vertically extending guide members pivotally mounted on vertical axes and disposed between the level of the axis of said magazine and the level of said pincers, said guides being engageable with longitudinal edges of said bags during the descent thereof.

6. The apparatus defined in claim 1 for an automatic filling machine in which a plurality of bags are advanced in a plurality of parallel lines which are parallel to the axes of respective magazines, each of said lines being provided with respective first and second members and respective pusher means.

* * * * *